US009540818B2

(12) United States Patent
McClure

(10) Patent No.: US 9,540,818 B2
(45) Date of Patent: Jan. 10, 2017

(54) ROOF RIDGE INTEGRATED WATER-SHEDDING APPARATUS

(71) Applicant: BlueScope Buildings North America, Inc., Kansas City, MO (US)

(72) Inventor: Richard R. McClure, Basehor, KS (US)

( * ) Notice: Subject to any disclaimer, the term of this patent is extended or adjusted under 35 U.S.C. 154(b) by 0 days.

(21) Appl. No.: 14/667,554

(22) Filed: Mar. 24, 2015

(65) Prior Publication Data

US 2015/0267412 A1 Sep. 24, 2015

Related U.S. Application Data

(60) Provisional application No. 61/969,460, filed on Mar. 24, 2014.

(51) Int. Cl.

| | |
|---|---|
| ***E04B 7/18*** | (2006.01) |
| ***E04D 3/30*** | (2006.01) |
| ***E04B 7/02*** | (2006.01) |
| ***E04D 3/40*** | (2006.01) |
| ***E04D 13/03*** | (2006.01) |

(52) U.S. Cl.

CPC . *E04D 3/30* (2013.01); *E04B 7/02* (2013.01); *E04B 7/18* (2013.01); *E04D 3/40* (2013.01); *E04D 13/0315* (2013.01); *E04B 2103/06* (2013.01)

(58) Field of Classification Search

CPC ..... E04D 13/0315; E04D 13/031; E04D 13/0305; E04D 13/032; E04D 3/30; E04D 3/40; E04B 7/18

USPC ..... 52/200

See application file for complete search history.

(56) References Cited

U.S. PATENT DOCUMENTS 1,090,186 A * 3/1914 Yauch ..... E04D 3/08 52/200
1,401,208 A * 12/1921 Sylvan ..... E04D 13/0351 52/199
1,769,013 A * 7/1930 Blaski ..... E04D 3/08 52/200
4,995,208 A * 2/1991 Sampson ..... E04D 13/0315 52/200
5,044,133 A * 9/1991 Sampson ..... E04D 13/0305 49/495.1
5,199,234 A * 4/1993 Guhl ..... E04D 13/0315 52/200
5,522,189 A * 6/1996 Mortensen ..... E04D 13/02 52/200

(Continued)

FOREIGN PATENT DOCUMENTS

JP 01190846 A * 7/1989
SI DE 4320321 A1 * 12/1993 ..... E04D 13/0354

(Continued)

OTHER PUBLICATIONS

PCT Patent Application No. PCT/US2015/022316 International Search Report and Written Opinion dated Jun. 29, 2015, 11 pages.

*Primary Examiner* — Adriana Figueroa

(57) ABSTRACT

A technique for installing a skylight at the ridge of the roof is used to redirect water away from the skylight by using a flashing member. Side rails containing a notch in the upper end are configured to receive a flashing member proximate the ridge of the roof. The flashing member redirects water away from the skylight without the use or installation of a diverter to reroute the water.

12 Claims, 6 Drawing Sheets

(56) References Cited

U.S. PATENT DOCUMENTS

| | | | | |
|---|---|---|---|---|
| 6,209,271 | B1 * | 4/2001 | Kovacs | E04D 13/0335 49/50 |
| 6,212,834 | B1 * | 4/2001 | Lindgren | E04D 13/031 52/200 |
| 7,134,254 | B1 * | 11/2006 | Van Gelder | E04D 13/0335 52/200 |
| 8,438,801 | B2 * | 5/2013 | McLain | E04D 13/0315 52/200 |
| 2008/0190050 | A1 | 8/2008 | McClure | |
| 2010/0162643 | A1 | 7/2010 | Blomberg et al. | |
| 2012/0240491 | A1 | 9/2012 | Voegele, Jr. et al. | |

FOREIGN PATENT DOCUMENTS

| | | | |
|---|---|---|---|
| WO | 2010009730 | A1 | 1/2010 |
| WO | 2010011604 | A1 | 1/2010 |

* cited by examiner

ROOF RIDGE INTEGRATED WATER-SHEDDING APPARATUS

BACKGROUND

Skylights are nonessential construction components that are added to structures to aid in the process of daylighting. Increasing the amount of natural light in a covered area serves an aesthetic purpose and allows the user to avoid searching for alternate means of lighting in the covered areas.

Diverters are typically used with skylights to redirect the path of rainwater. They are necessary to provide a drainage area and to keep water or other elements from entering the building. The diverters are installed at the top, upslope side of the skylight in order to help move rainwater away from critical joints of the skylight.

In order to install the diverter, a notch must be cut in the corrugation of the roof panel. Also, a diverter support plate is implemented in order to bolster withstand the force exerted on the diverter by the elements. More specifically, since the typical skylight is installed a considerable distance down the roof from the ridge, the runoff, by the time it reaches the diverter is moving swiftly and has considerable flow volume. This flow presents a challenge that must be met by the diverter, and can compromise the seals. After the notch is cut for the diverter, the diverter support plate is slid into place beneath the roof panel and clamped into position. The diverter is similarly secured into position. After the parts have been secured, the diverter, roof panel, and diverter support plate are fastened together, and sealant is added as required to fill voids and gaps to seal the system. These seals all present potential leak points.

SUMMARY

This invention relates to a skylight system for a roof. The roof has a ridge at the top, and the system includes side rails, a flashing with a trough area and a barrier face, and a ridge cap which covers the ridge. These items can be included in a kit. The flashing and side rails can abut the roof panel closure. Other installation components include a ridge retainer and a water shedding lap to be used in conjunction with the ridge cover in order to provide a weathertight seal. The flashing can have a lip at the opposite end of the trough from the barrier face which fits over the top of the roof panel closure. A frame and window are installed into the skylight.

Additionally, this invention discloses a daylighting kit which includes side rails containing a notch, a flashing member, a ridge cover, a skylight frame, and a window that is disposed over a roof penetration in close proximity to the roof ridge. Placing the skylight in close proximity to the roof ridge will decrease the volume of water that impacts the elevated end of the skylight and thereby decreases the potential for the development of leaks. With this placement of the skylight, proximate the ridge, the rainwater has not acquired much energy from downward movement on the roof surface before impacting the side surface of the daylighting kit. Consequently, there is no need for a diverter to reroute the water around the frame, as the water flows onto the roof from the elevated flashing member. The skylight contains an upper and rear closure to further waterproof the skylight.

This configuration of components for placement of the skylight proximate the roof ridge also simplifies the installation process and because of the increased elevation of the skylight, proximate the ridge, the total illumination provided by the skylight to the interior of the structure is increased over that provided by a similar skylight at a lower elevation. The flashing is assembled on the skylight by installing the side rails, attaching the flashing member to the side rails, and installing a ridge cap over the roof ridge. Safety guards or security bars can be installed to further protect the opening in the roof configured to receive the window and frame.

DETAILED DESCRIPTION

The disclosed technology is directed to a system, kit, and method for a skylight placed at the ridge of the roof in order to increase the amount of natural lighting inside the structure. More specifically, these technologies eliminate the need for a diverter for the handling of run off during rain. This reduces system complexity, and makes installation simple. A special pan flash is used to make the system installable at the ridge.

By utilizing a pan flash, there is no need to cut through the roof corrugations in order to install a diverter. In one embodiment the flashing member is located proximate the ridge of the roof so that the rainwater is redirected using the pan flash. In this embodiment there is no need to install a diverter to redirect the rainwater. Because there is no need to cut through the roof corrugations to provide a drainage route, utilizing a pan flash is a much simpler and efficient method of redirecting the flow of water at the upper end of the skylight. Further, since the roof panel did not need to be cut, this results in an increased weather-tight seal.

The primary installation components for the at-ridge skylight include a frame and a window for the skylight, side rails, a lower rear closure, and a pan flash. The window may, in embodiments, comprise a pane, dome, or lens consisting of at least a semi-transparent material. The purpose of the skylight is to daylight the interior of the structure. But during rain or upon encountering other elements, water can impinge on the frames of the conventional system designs. Thus, with these systems, water must be directed away from the window. Effectively directing water away from the skylight is necessary to alleviate the potential for leakage through the hole in the roof, as well as other structural damage that can occur from condensation breaching the roof and skylight barrier.

The present invention can be installed before or after the roof of a structure has been assembled. If the skylight is installed on a pre-assembled roof, the existing roof ridge and ridge retainer need to be removed to accommodate the skylight.

Figure 1:
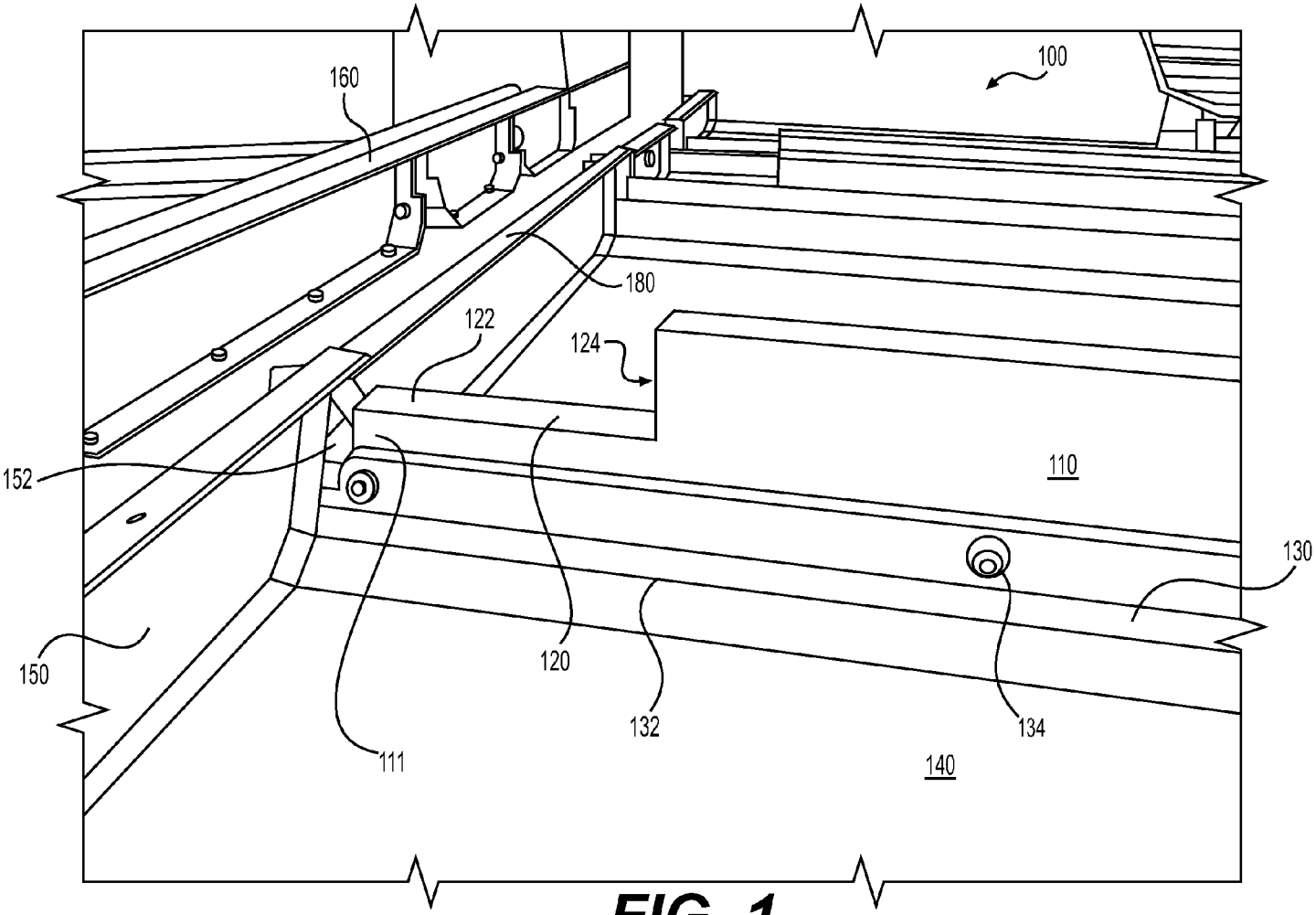
FIG. 1 is an angled view of the side rails attached to the roof at the ridge before the pan flash, dome frame, or lens has been installed.
Figure 2:
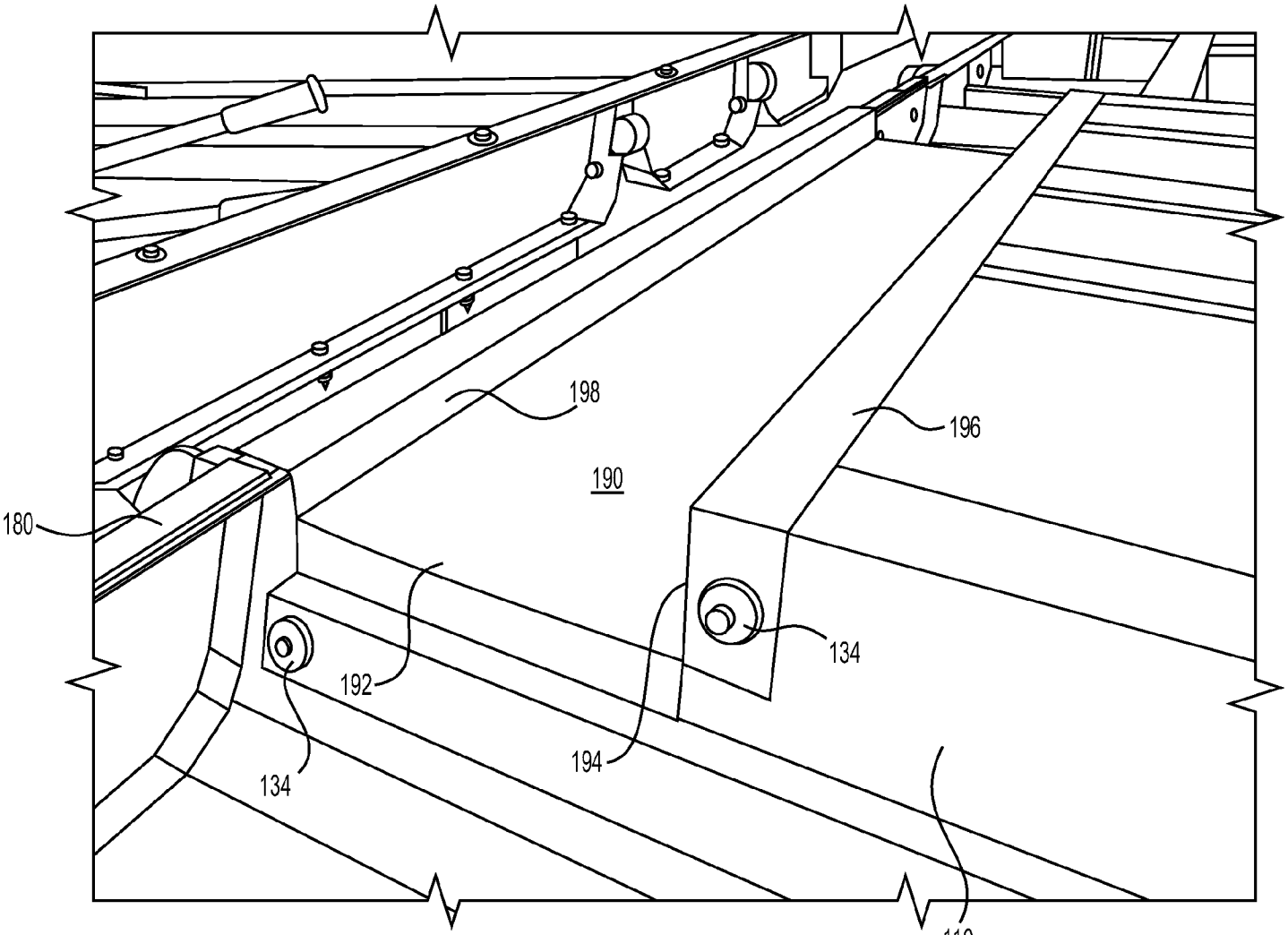
FIG. 2 is an enlarged view of FIG. 1 after the pan flash has been installed.
Figure 6:
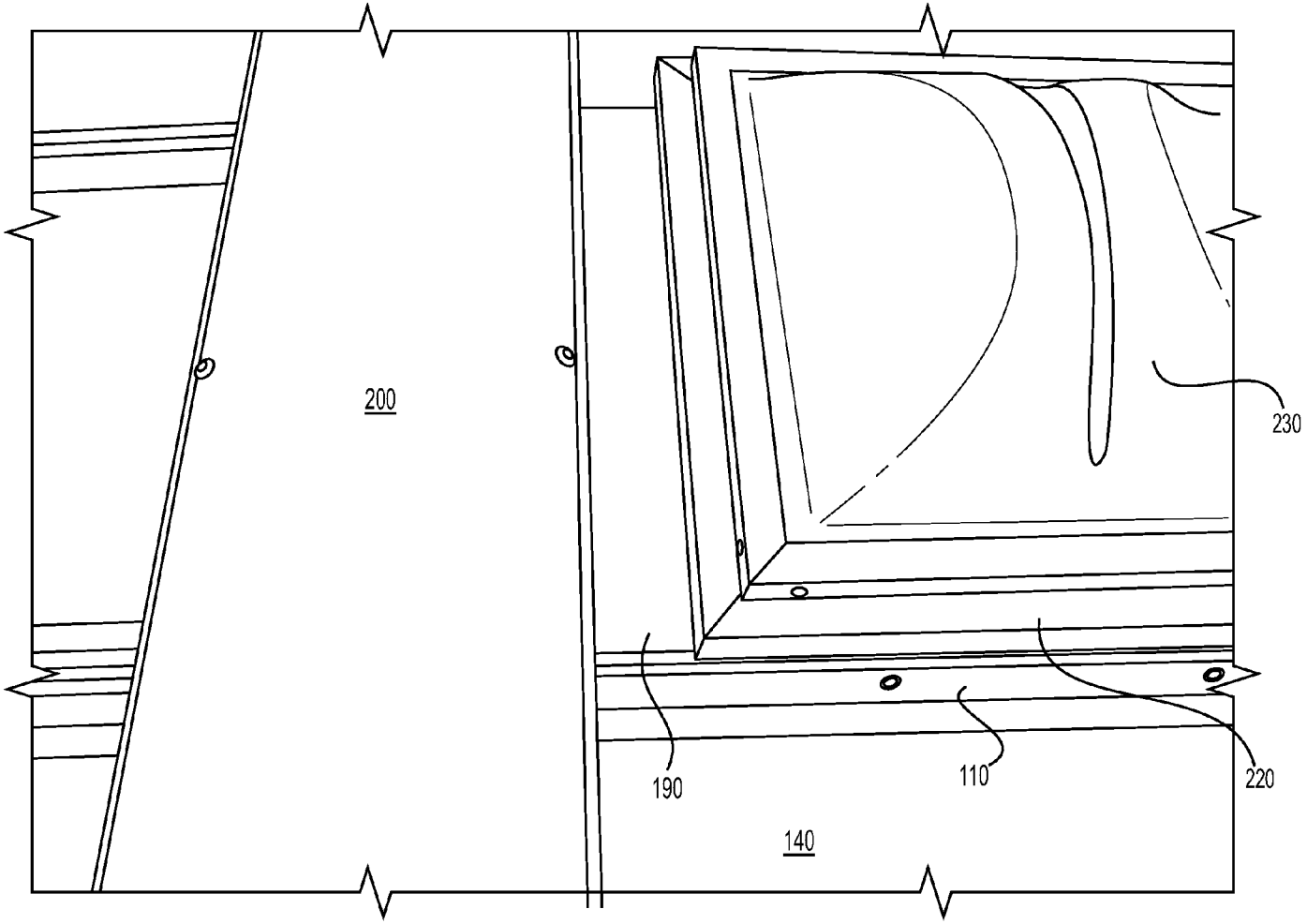
FIG. 6 is a view of the ridge after the ridge cover, dome frame, and lens have been installed. This is a view of the finished product.

As seen in FIG. 1, a system for a skylight 100 is described. A first and second side rail 110 each having an upper end 111 and a lower end is installed at the ridge of the roof. The side rails 110 contain a flanged notch 120 which is disposed within the upper end of the side rails. The notch has a lower face 122 and an upright face 124. The notch 120 is configured to receive a pan flash 190 (as seen in FIG. 2). The side rails 110 are installed to run in parallel on the roof downward from the ridge. The upper end of the side rails 110 are installed at the ridge of the roof so that the notch 120 is at the ridge. The side rails 110 are configured to the length of a frame 220 for a skylight window 230 (as seen in FIG. 6).

In one embodiment the side rails 110 are aligned to be secured to the roof panel 130 at the top edge of a corrugation 132. In one embodiment, the roof panel 130 and corrugation 132 are part of a standing seam roof 140. The upper ends 111 of the side rails 110 abut the roof panel closure 150, and rest in the cutout 152 in the roof panel closure 150 designed to accept the elevated corrugations 132. Adhesives, sealants, or some combination of the two may be used to further secure the side rails 110 to the roof panel closure 150. In one embodiment, prior to installation, tape sealant is placed on the edge of the side rails 110 which will be attached to the roof panel 130, as well as along the roof panel 130 where the side rails 110 will be attached in order to further waterproof the connection between the roof panel 130 and the side rails 110. The side rails 110 may be secured to the roof panel 130 with clamps while the side rails 110 are being attached to the roof panel 130. In one embodiment the side rails 110 are attached to the corrugations 132 of the roof panel 130 using rivets 134 to lock the side rails 110 in place.

As shown in FIG. 2, the pan flash 190 consists of a substantial trough area 192, a perpendicular upright area 194 which serves as the barrier face of the flashing, and an upper area 196 which sits atop the side rail 110. The lower end of the pan flash 190 is approximately located where the upper end of the skylight begins. In one embodiment, the pan flash 190 has an additional perpendicular area 198 at the other end of the trough which overlays the upper surface of the roof panel closure 180. The pan flash 190 is secured to the notches 120 existing in the upper ends of the side rails 110. The pan flash 190 spans the parallel notches 120. In one embodiment, the pan flash 190 extends beyond the side rails and may be bent to conform to the notches 120 and the side rails 110 in order to provide a more effective seal.

Figure 3:
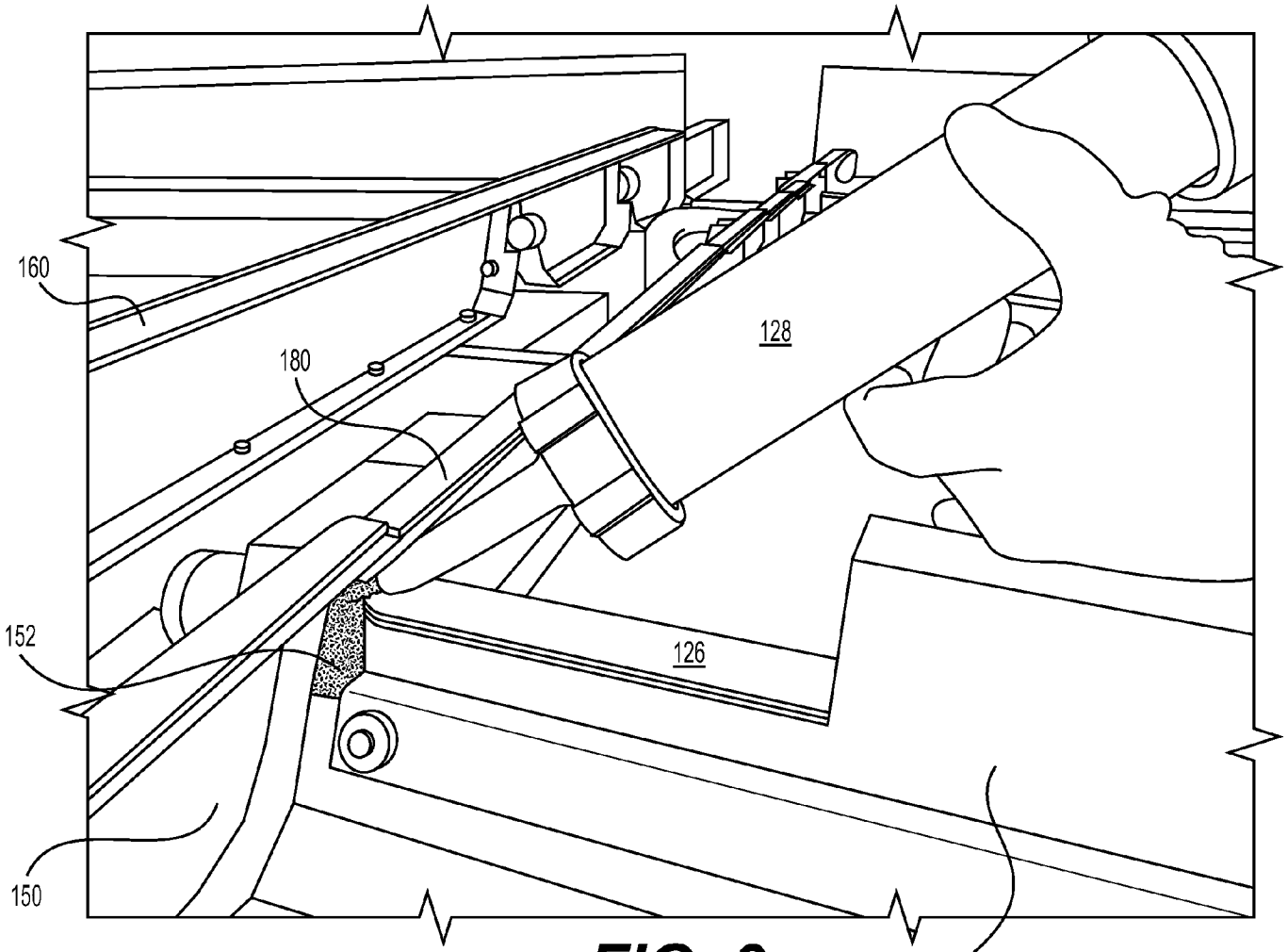
FIG. 3 is an enlarged view of FIG. 1 in which sealant has been applied on the trough area of the pan flash, and additional sealant is in the process of being applied.

As shown in FIG. 3, in one embodiment, tape sealant 126 is applied to the lower face of the notch 122 and sealant 128 is applied to the roof panel closure 150. Returning to FIG. 2, the pan flash 190 is placed over the notch 120 and the side rail 110, and the pan flash 190 is clamped to the side rail 110 and secured using one or more rivets 134 to lock the pan flash 190 into place.

Figure 4:
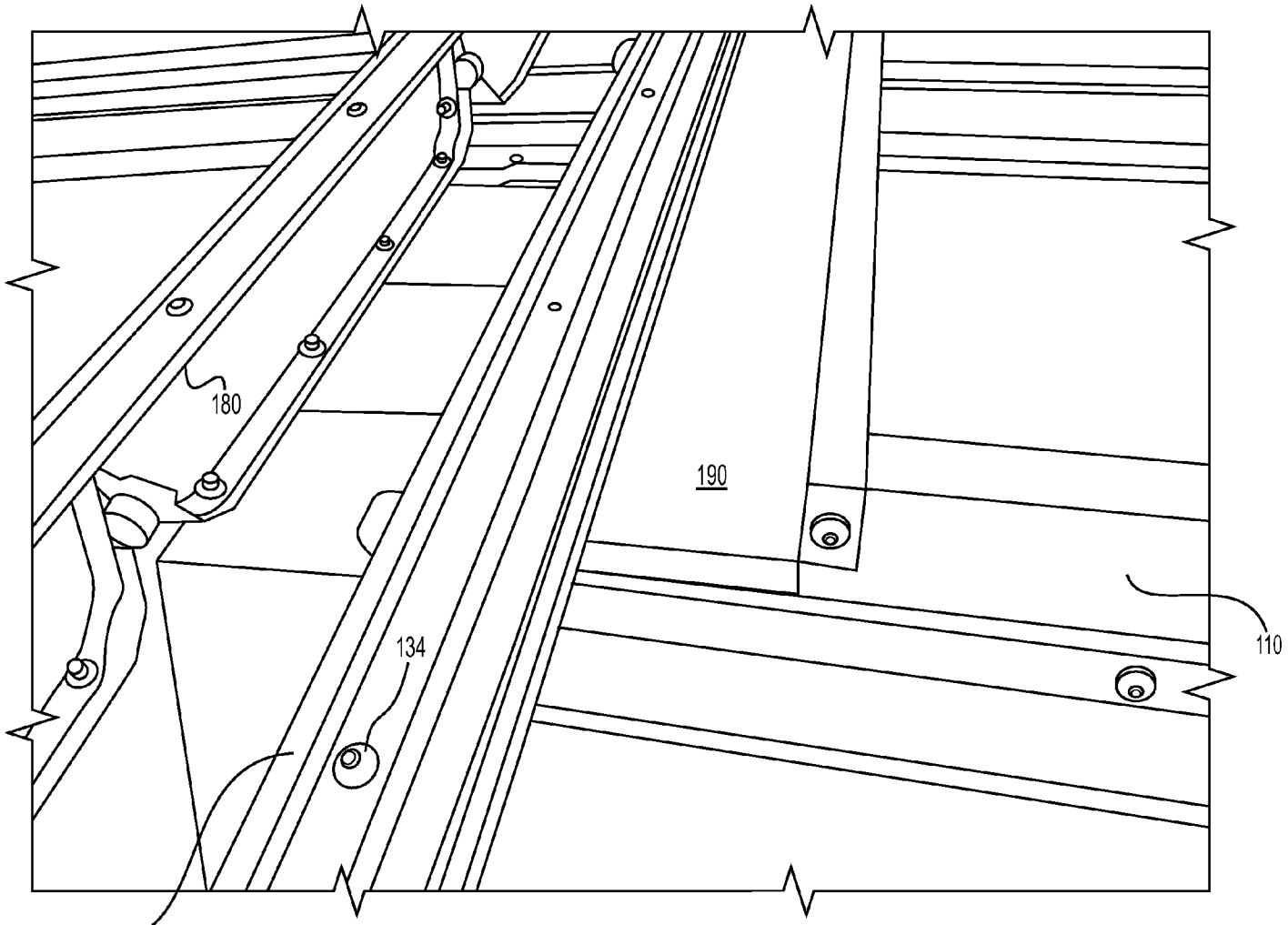
FIG. 4 is a view of the side rails, ridge, and pan flash after the ridge retainer has been installed.

As shown in FIG. 4, the ridge retainer 160 is attached to the upper surface of the roof panel closure 180 after the side rails 110 and pan flash 190 have been secured to the roof panel 140. In one embodiment, foam tape is applied to the upper surface of the roof panel closure 180 and the pan flash 190 where the ridge retainer 160 rests on the pan flash 190. The ridge retainer 160 is secured at the upper surface of the roof panel closure 180. In one embodiment, the ridge retainer 160 is secured using rivets 134.

In one embodiment, an upper closure is installed over the pan flash 190, specifically over the perpendicular barrier 194 and the upper area 196 which sits atop the side rail 110. In one embodiment, adhesive sealant is placed on the upper closure before securing the upper closure to the flash pan 190, the upper closure is secured to the flash pan 190 using rivets 134, and any voids are filled with sealant 128.

Figure 5:
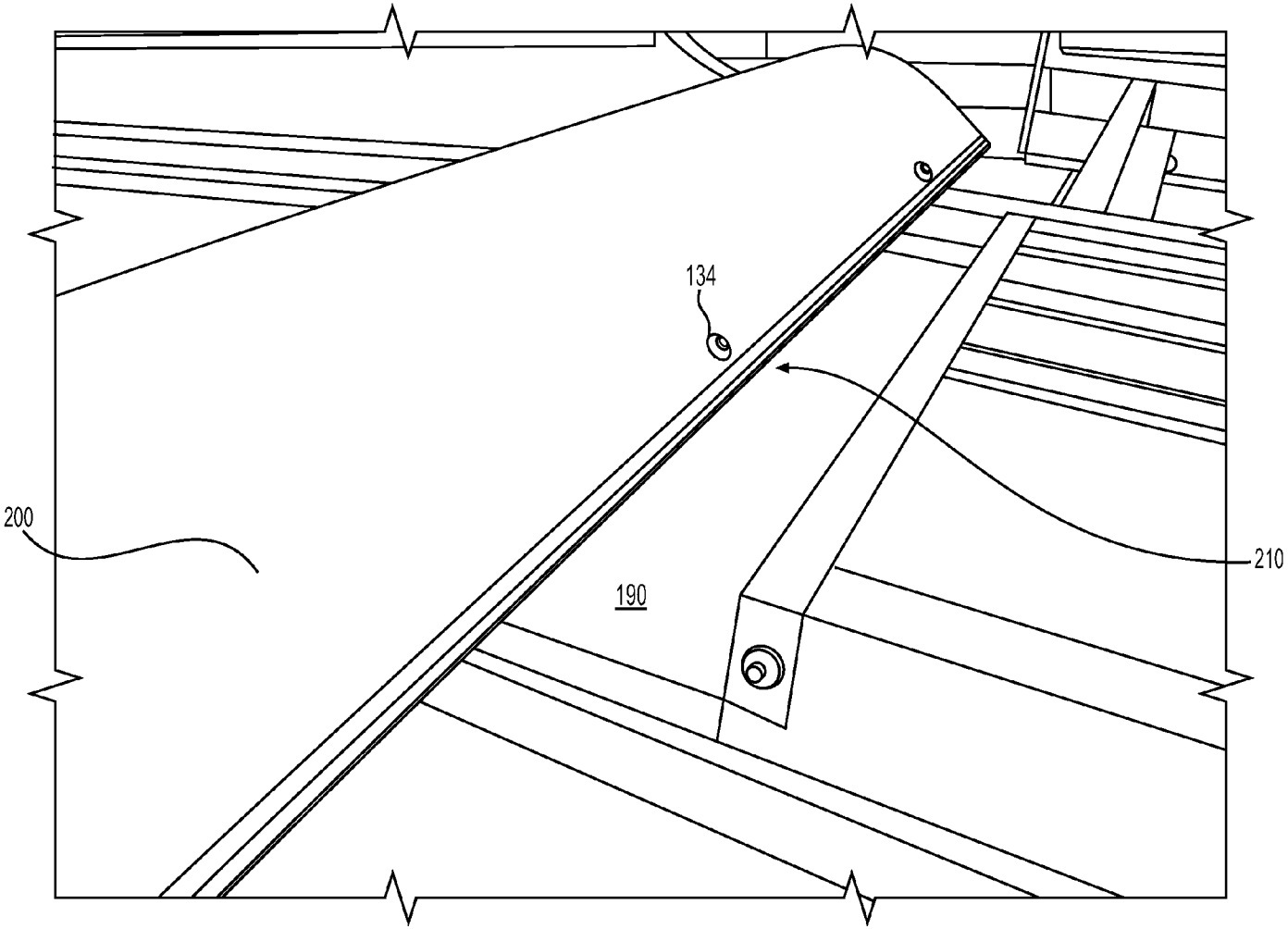
FIG. 5 is a view of the ridge after the ridge cover has been installed.

As seen in FIG. 5, the ridge cover 200 is secured over the ridge retainer 160. In one embodiment, the ridge cover 200 and ridge retainer 160 contain a water shedding lap 210. In another embodiment, foam tape is applied to the ridge retainer 160 where the ridge cover 200 will sit on the ridge retainer 160, and the ridge cover 200 is secured to the ridge retainer 160 using rivets.

In another embodiment and not pictured, placement of the rear closure is identified and the lower rear closure is clamped into place. An access hole is cut in the roof panel. In one embodiment, after the access hole is cut and debris is removed, adhesive sealant is applied to the surface of the lower rear closure that will adhere to the roof panel, and the lower rear closure is secured to the roof panel and the side rails with rivets and bolts. The upper rear closure is secured to the lower rear closure and the side rail. In one embodiment, adhesive sealant is applied to the vertical leg of the upper rear closure, the upper rear closure is attached to the lower rear closure and the side rails using rivets, and any voids are filled with sealant.

Installation of the rear closure encloses the area of the roof panel which will be cut away to create the opening for the skylight, more specifically, the area enclosed by the side rails, the pan flash, and the lower closure. This area of the roof panel is removed. In one embodiment, the roof panel is cut away using electric shears and discarded. The insulation is trimmed and removed. In one embodiment, the insulation is trimmed along the parallel side rails. Some insulation is left in order to help insulate the side rails. The roof facing is cut roughly down the middle between the parallel side rails. After the roof facing is cut, the roof facing is pulled up toward the top of the side rail capturing the insulation next to the side rail. In one embodiment, the facing containing the insulation is secured to the side rail using a foam retaining rod, and once the insulation and facing are secured against the side rail the excess facing is trimmed.

In one embodiment, foam tape is applied to the top of the side rails, upper closure, and rear closure. In another embodiment, the inside corners of the inside enclosure formed by the two parallel side rails, the pan flash, and the rear closure have an inside trim installed which is secured to the inside corner by screws. In one embodiment the trim is made from PVC.

In one embodiment, a safety guard is installed in the skylight space. The safety guard may be attached to the side rails, upper closure, and lower closure by clips or other adhesives. Foam tape may be applied to the upper edge of the side rails, upper closure, and lower closure after the safety guard is installed. In another embodiment, security bars may be installed which span the skylight opening. Foam tape is applied to the top surface of the security bar frame after it has been installed.

As shown in FIG. 6, the frame 220 and window 230 are installed. In another embodiment the frame and window are prepackaged as a skylight dome. In one embodiment, adhesive sealant is applied to the surface on the frame that overlays the side rails, upper closure, and rear closure. The frame 220 and window 330 are secured to the side rails 110, upper closure, and rear closure using screws.

What is claimed:

1. A skylight system for a roof, the roof having a ridge at the roof top, the roof having at least two spaced-apart-substantially-parallel corrugations running up and down the roof, the roof having a ridge at an uppermost part of the roof, the system comprising:

a pair of opposing side rails configured for installation on top of the two corrugations, said side rails adapted to support a skylight;

a pan flash having an upper edge configured for sealed securement to the side rails, the pan flash having a trough area below the upper edge, a barrier face, and a perpendicular upright area and lip at the opposite end of the trough from the barrier face and the upper edge overlaying the upper surface of a roof panel closure;

the trough area and the barrier face of the pan flash being laterally supported by notches made in the upper ends of the side rails, the notches adapted to receive and support the pan flash at two different lateral positions such that said pan flash extends across an area in front of the side rails;

a ridge cap installable over the upper end of the pan flash such that a downwardly extending edge of the ridge cap terminates in the trough area of the pan flash.

2. The system of claim 1 wherein the skylight, side rails, flashing, and ridge cap are included in a kit.

3. The system of claim 1 wherein the trough area is adapted to run substantially parallel to a roof slope, and the barrier face runs substantially upward and perpendicular to the roof slope.

4. The system of claim 1 wherein the ridge cap is installed over a ridge retainer and a water shedding lap.

5. The system of claim 1, wherein the upper ends of the side rails abut a roof panel closure at the ridge of the roof.

6. The system of claim 1, further comprising a frame and a window for the skylight.

7. The system of claim 6, wherein a window refers to a pane or lens comprised of at least a semi-transparent material.

8. The system of claim 6, wherein the frame and window are pre-assembled to form a dome.

9. A kit for daylighting a roof on a building, the roof having a ridge at an upper most location, the kit comprising;

a first side rail extension and a second side rail extension, each extension with an upper and lower end, and adapted to be installable onto adjacent first and second corrugations of a roof panel, the first and second side rail extensions each having a notch at the upper end;

a pan flash member sized to extend laterally between the side rail extensions upon installation, the pan flash member having an upper securement edge adapted to be sealably secured to the side rail extensions, the pan flash member having a trough portion spanning between the first and second side rail extensions, the pan flash canted downwardly consistent with the roof slope and further comprising a first perpendicular upright area adapted to act as a water barrier and a second perpendicular upright area at an end opposite the first perpendicular upright area, the second perpendicular upright area having a lip overlaying an upper surface of the roof panel closure, the trough and the first perpendicular upright area configured to fit into the notches such that the pan flash is securable at lateral locations at the upward ends of the side rails;

a ridge cover having an edge that is adapted to downwardly extend towards the trough portion upon installation;

a skylight frame adapted to extend across and sealably overlay the first and second side rail extensions; and a window for insertion into the skylight frame.

10. The kit of claim 9, further comprising a ridge retainer which supports the ridge cover.

11. The kit of claim 10, wherein the ridge retainer contains a water shedding lap.

12. The kit of claim 9, wherein the window is a pane or lens comprised of at least a semi-transparent material.

* * * * *